US007694441B2

(12) United States Patent
Clymans

(10) Patent No.: US 7,694,441 B2
(45) Date of Patent: Apr. 13, 2010

(54) DEVICE AND METHOD FOR DISLODGING AND RECOVERING DREDGING MATERIAL OF VARYING NATURE

(75) Inventor: Etienne Clymans, Tisselt (BE)

(73) Assignee: Dredging International N.V., Zwijndrecht (BE)

( * ) Notice: Subject to any disclaimer, the term of this patent is extended or adjusted under 35 U.S.C. 154(b) by 681 days.

(21) Appl. No.: 10/560,612

(22) PCT Filed: Jun. 10, 2004

(86) PCT No.: PCT/BE2004/000084

§ 371 (c)(1),
(2), (4) Date: Jun. 7, 2006

(87) PCT Pub. No.: WO2004/111353

PCT Pub. Date: Dec. 23, 2004

(65) Prior Publication Data

US 2006/0236566 A1 Oct. 26, 2006

(30) Foreign Application Priority Data

Jun. 13, 2003 (BE) ..... 2003/0355

(51) Int. Cl.
*E02F 3/08* (2006.01)

(52) U.S. Cl. ..... 37/327

(58) Field of Classification Search ..... 37/321–324, 37/327, 328, 337, 342–344
See application file for complete search history.

(56) References Cited

U.S. PATENT DOCUMENTS 469,941 A 3/1892 McDougall
682,024 A * 9/1901 Bradley ..... 37/327
727,691 A * 5/1903 Robinson ..... 37/327

(Continued)

FOREIGN PATENT DOCUMENTS

DE 26 08 665 A1 9/1977

(Continued)

OTHER PUBLICATIONS

International Search Report and International Preliminary Examination Report.

(Continued)

*Primary Examiner*—Thomas B Will
*Assistant Examiner*—Mai T Nguyen
(74) *Attorney, Agent, or Firm*—Harness, Dickey & Pierce, P.L.C.

(57) ABSTRACT

Device for dislodging and recovering dredging material of varying nature, comprising a bearing housing (25), a drive shaft (11) mounted therein for rotatingly driving with a determined torque a cutter head (10, 10') with a support ring (15, 15'), which cutter head is mountable on the drive shaft via a hub (9), and a suction pipe (13) which can be connected to a suction mouth (14, 14') which is surrounded by a fixed cutter shield (21, 21') which fills the space between the rotating support ring on the one side and the suction mouth and the bearing housing on the other, wherein a number of cutter heads with a different support ring diameter can be mounted on the drive shaft, wherein the support ring diameter is determined by the torque and the nature of the dredging material to be recovered.

18 Claims, 6 Drawing Sheets

U.S. PATENT DOCUMENTS

| | | | | | |
|---|---|---|---|---|---|
| 977,901 | A | * | 12/1910 | Robinson | 37/325 |
| 1,087,269 | A | * | 2/1914 | Baltz | 37/327 |
| 1,758,047 | A | * | 5/1930 | Jensen | 37/318 |
| 1,759,490 | A | * | 5/1930 | Neveling | 37/322 |
| 1,821,177 | A | | 9/1931 | Ellis | |
| 2,002,749 | A | | 5/1935 | Neveling | |
| 2,017,816 | A | * | 10/1935 | MacFadyen | 37/327 |
| 2,057,691 | A | * | 10/1936 | Ranney | 37/323 |
| 2,121,858 | A | * | 6/1938 | Chew | 175/213 |
| 2,233,943 | A | * | 3/1941 | Gaylord | 37/328 |
| 2,678,203 | A | * | 5/1954 | Huff | 175/213 |
| 2,956,354 | A | * | 10/1960 | Varner | 37/323 |
| 3,004,392 | A | | 10/1961 | Symmank | |
| 3,739,503 | A | * | 6/1973 | Barker et al. | 37/308 |
| 3,807,066 | A | * | 4/1974 | Proehl | 37/327 |
| 4,050,170 | A | * | 9/1977 | Proehl | 37/328 |
| 4,296,970 | A | * | 10/1981 | Hodges | 299/67 |
| 4,327,507 | A | * | 5/1982 | Volbeda | 37/323 |
| 4,365,427 | A | * | 12/1982 | Chapman | 37/327 |
| 4,403,428 | A | * | 9/1983 | Chapman et al. | 37/319 |
| 4,418,484 | A | * | 12/1983 | Wolters et al. | 37/323 |
| 4,597,200 | A | * | 7/1986 | van der Meer et al. | 37/336 |
| 4,702,024 | A | * | 10/1987 | Shiba et al. | 37/327 |
| 4,728,256 | A | | 3/1988 | Araoka et al. | |
| 4,753,023 | A | * | 6/1988 | Little | 37/325 |
| 6,053,663 | A | * | 4/2000 | Dikken et al. | 405/163 |

FOREIGN PATENT DOCUMENTS

| | | |
|---|---|---|
| JP | 52-93144 | 8/1977 |
| NL | 7302167 | 8/1974 |
| NL | 7408623 | 12/1975 |

OTHER PUBLICATIONS

International Search Report and International Preliminary Report on Patentability for PCT/BE2004/000084.

* cited by examiner

DEVICE AND METHOD FOR DISLODGING AND RECOVERING DREDGING MATERIAL OF VARYING NATURE

The invention relates to a device for dislodging and recovering dredging material of varying nature, comprising a bearing housing, a drive shaft mounted therein for rotatingly driving with a determined torque a cutter head with a support ring, which cutter head is mountable on the drive shaft via a hub, and a suction pipe which can be connected to a suction mouth which is surrounded by a fixed cutter shield which fills the space between the rotating support ring on the one side and the suction mouth and the bearing housing on the other.

Such devices are generally known in a cutter suction dredger for recovering dredging material. In the construction of a cutter suction dredger an optimization for a specific type of material is typically-carried out, either for a hard material such as rock, or for a softer material such as sand.

The dredging of hard bed material such as rock and stone requires on the one hand that the teeth of the cutter head can produce a great cutting force. This means that for a determined torque the smallest possible diameter of the cutter head is desired for this type of material. It is furthermore a known phenomenon that during dredging of rock or stone a large part of the cut bed material is not sucked up by the dredge pump via the suction mouth, but is left behind on the already dredged bottom as spillage. In order to keep this spillage as low as possible it is also advantageous for the cutter to be as small as possible. The cutting process is hereby situated as close as possible to the suction mouth. The inflow speed of the transport water to the suction mouth must on the other hand be as high as possible so as to transport the cut stones as well as possible to the suction mouth. A small entry section of the suction mouth, and thus high water speed at the entry to the suction mouth are therefore advantageous.

Conversely, considerably lower forces are required for dredging of less hard material such as sand or gravel, and it is advantageous to use a cutter head with a relatively large diameter so that the quantity of bed material being cut into is greater, and a greater production is achieved. When dredging sand or gravel it is advantageous to have a cutter head larger than the optimal cutter head for rock. The quantity of bed material being cut into can then become larger, thereby enabling a greater production.

In a larger cutter the suction mouth can also be given a larger construction. When dredging sand much more bed material is after all supplied to the suction mouth, so that dredging can take place with higher densities. For an economic pumping process it is advantageous to realize the hydraulic transport of the bed material being cut at the highest possible densities, this at the lowest possible speeds, wherein the bed material does not quite sediment. The wear to pumps and conduits, as well as the energy required for transport, are then minimal. A larger suction mouth is an advantage here because it enhances the inflow of the cut bed material. Because during the dredging of sand operation often also takes place toward the limit of the maximum suction height of the dredge pump, it is an advantage for the hydraulic entry losses in the suction mouth to be as low as possible. In view of the above, it is an advantage in the dredging of sand to apply a larger suction mouth than that which is optimal for rock.

An optimization has heretofore been carried out in the construction of a cutter dredger for either rock cutting or sand cutting, or for neither of the two. Each of these cutter dredgers is then not optimal and thus less competitive in the application for which it has not been optimized.

The invention has for its object to propose a device for recovering dredging material of varying nature, which device allows technical optimization of the production for dredging rock and stone as well as for dredging bed material, so that the device can be optimally productive and competitive in both fields of application.

For this purpose the device according to the invention has the feature that a number of cutter heads with a different support ring diameter can be mounted on the drive shaft, wherein the support ring diameter is determined by the torque and the nature of the dredging material to be recovered.

The support ring diameter and the line of the teeth points of the cutter head to be mounted can thus be chosen as a function of the bed material type and the torque available on the cutter head, or in other words as a function of the required force of the teeth, whereby it is possible to operate more efficiently. It is thus possible, depending on the material for dredging, to mount a cutter head with a suitable support ring diameter by means of the same hub on the drive shaft, which is a simple operation which can take place rapidly and efficiently on board a dredging vessel.

For a cutter head with a relatively small diameter suitable for instance for rock, this will moreover have the additional advantage that the cutting process takes place closer to the suction mouth, whereby the cut-away pieces of rock can be sucked up easily into the suction mouth, and the spillage remains limited.

According to a further developed embodiment of the device according to the invention, a number of suction mouths with a different entry section can be connected to the suction pipe, wherein the entry section of the suction mouth is determined by the nature of the dredging material to be recovered.

In this way a suction mouth can be connected for a material such as sand or gravel which has an entry section which is larger than that which would be connected in order to dredge for instance rock. For an economic pumping process it is an advantage to operate with the highest possible density of dredging material in the surrounding water to be transported, at the lowest possible speed, this without the dredging material sedimenting. For a material such as rock this transporting speed will have to be higher than for sand in order to avoid sedimentation, which for rock means that a smaller entry section of the suction mouth is required for optimum production.

According to a further feature of the invention, the dimensions of the suction mouth are adapted such that in the operative position the bottom end fits closely between the cutter shield and the support ring of the associated cutter head.

A further developed embodiment of the device according to the invention further comprises a cutter ladder, and a number of cutter shields can be mounted against the cutter ladder which, during use of different cutter head/suction mouth combinations, allow the cutter shield to be connected on one side to the edge of the bearing housing and the suction mouth and on the other side to the inner edge of the support ring and the front end of the cutter ladder.

The shaft is retained permanently, whereby the hub of the different cutter heads remains in the same position relative to the cutter ladder. A part of the greater axial length of a cutter head with larger support ring diameter is hereby situated in the direction of the cutter ladder. The support ring of this cutter head thus lies further over the cutter ladder than that of a cutter head with a smaller support ring. In order to cause the cutter shield to fit closely against the inner edge of the support ring on one side and to also fit onto the contour of the front edge of the diverse suction mouths on the other side, there is provided the option of mounting diverse modified cutter shields on the same cutter ladder.

According to a possible variant, the cutter shield takes the form at the bottom of a truncated cone in the direction of the cutter head, wherein the smaller the support ring diameter of the cutter head to be mounted, the greater is the angle of opening of the truncated cone of the cutter shield to be mounted, in order to fit onto the inner diameter of the support ring.

This cone can be extended by means of a peripheral edge as far as the front side of the cutter ladder. The diverse cutter shields can for instance all be fixed in the same manner to the cutter ladder. That is, by sliding these shields at the front over the cutter bearing housing and the suction mouth and screwing them fixedly on the rear periphery to the front end of the cutter ladder. This makes replacement simpler.

According to another aspect of the invention, at least one nozzle is provided for spraying a fluid, typically seawater, under high pressure into the dredging material cut into by the cutter head.

Production can hereby be increased further, particularly for sand, for which a cutter head is used with a relatively large diameter. Injection of a fluid under high pressure ensures that the negative water pressure created during cutting into for instance a sandbank is immediately relieved by the injected fluid. The foot of the bank being cut into hereby collapses immediately and an extra quantity of sand can be sucked up, as will be described in detail with reference to FIGS. 5 and 6. Breaching sand forms a significant part of the production particularly in sandy bed material. The more regular, more rapid and larger-scale breaching has the effect of increasing production considerably. In addition to this effect, the water jet also has a directly eroding function which likewise increases the quantity of dislodged sand in front of the suction mouth, and therefore increases production.

According to a possible embodiment variant of the device according to the invention, the drive shaft takes a hollow form in order to form a channel for the fluid under pressure, wherein the at least one nozzle is mounted on the outer end of the drive shaft connected to the cutter head.

This construction has the advantage of being very robust.

The invention further relates to a cutter suction dredger for dislodging and recovering dredging material, comprising a variant of the device according to the invention.

Finally, the invention likewise relates to a method for dislodging and recovering dredging material using a device according to the invention, which method is distinguished in that the diameter of the support ring of the cutter head is selected as a function of the dredging material to be recovered and the torque, wherein a smaller diameter is selected for a harder material, and that the selected cutter head is connected to the drive shaft.

According to a more advanced embodiment of the method according to the invention, a suction mouth with a determined entry section is selected as a function of the dredging material to be recovered, wherein a smaller entry section is selected for a harder dredging material, and the selected suction mouth is connected to the suction pipe.

The invention will be further elucidated on the basis of the annexed drawing and the figure description hereinbelow, in which among others an exemplary embodiment of a device according to the invention will be illustrated. In the drawing.

Figure 1:
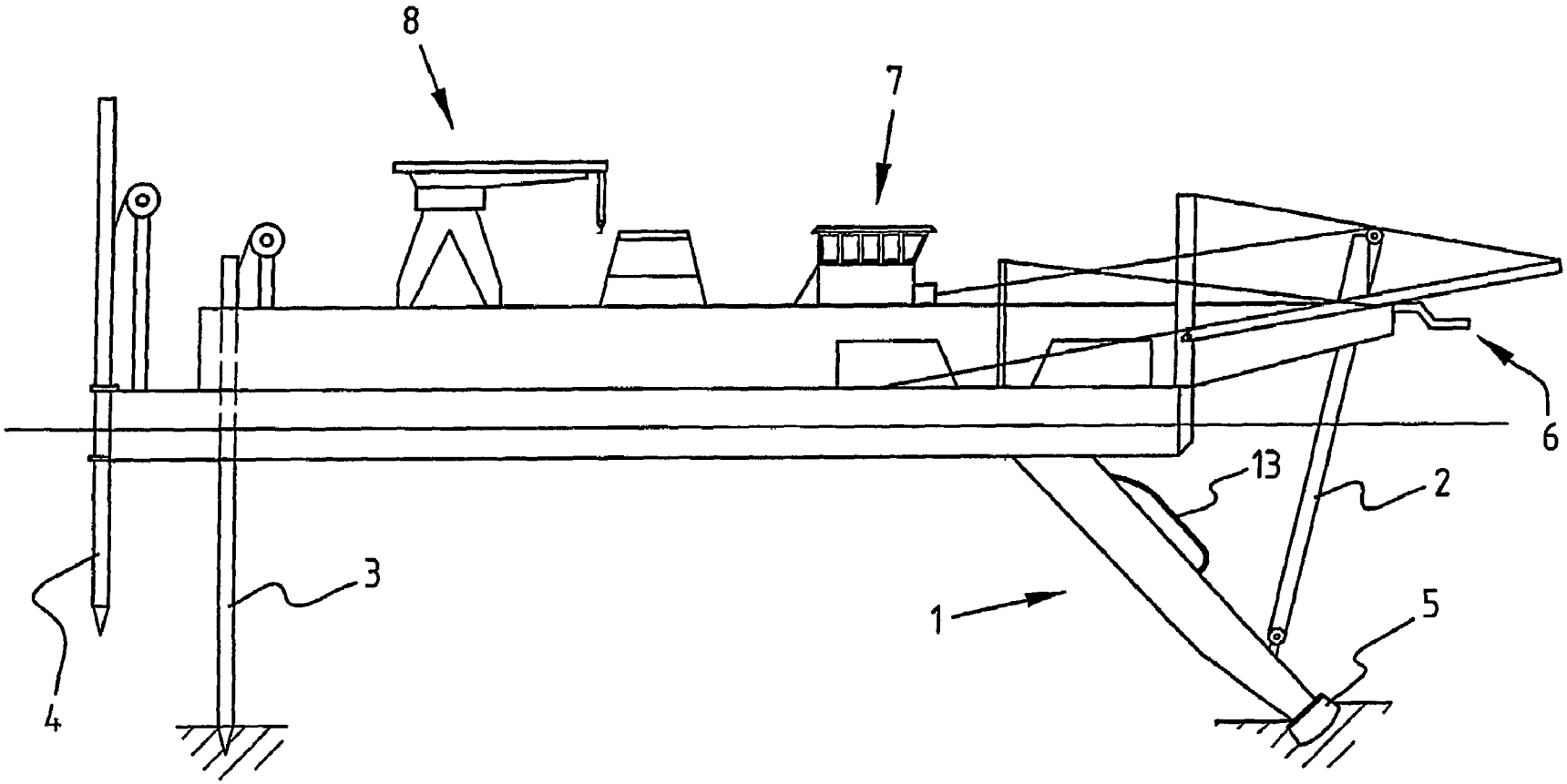
FIG. 1 shows a side view of a ship with a cutter suction dredger.

FIG. 1 shows a dredging vessel with cutter suction dredger. The typical components of such a ship are a ladder 1, two anchor or spud posts 3, 4, and a ladder cable with ladder winch 2. Situated on the outer end of ladder 1 are the cutting means in the form of a cutter head 5, and provided along ladder 1 are suction means 13 which comprise a suction line and a pump.

The ship is further provided with a deck crane 8 for all kinds of operations on deck, a bridge 7, a work-platform 6, for instance for performing maintenance operations on cutter head 5.

During dislodging of the bed material only one spud pole 3 is used. The second spud pole 4 is used when the first spud pole 3 has to be displaced.

Figure 2A:
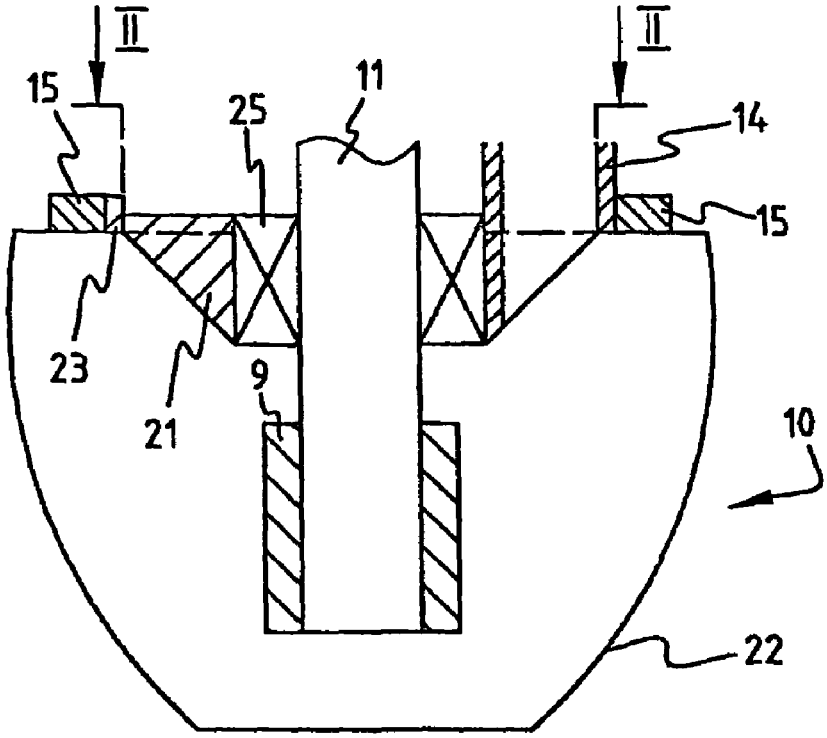
FIG. 2A is a schematic axial section of a part of a device according to the invention on which are mounted a cutter head, suction mouth and cutter shield (cutter shield), for instance for relatively soft bed material, sand etc.
Figure 2B:
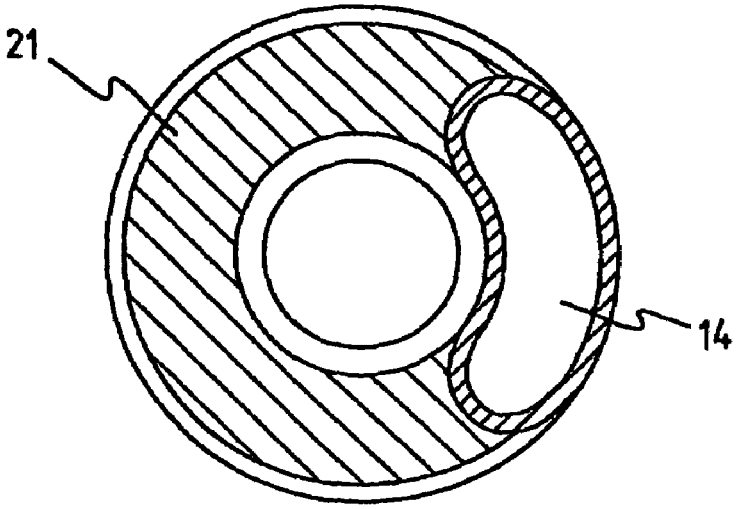
FIG. 2B shows a cross-section along line II-II in FIG. 2A.
Figure 2C:
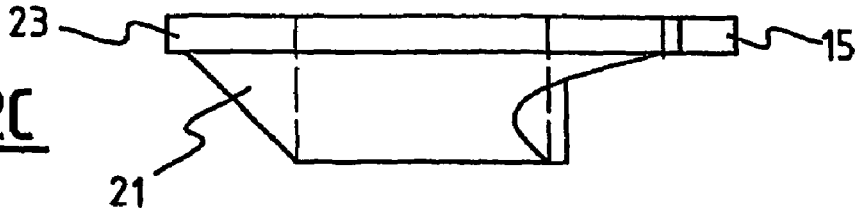
FIG. 2C shows a bottom view of the cutter shield used in the device of FIG. 2A, on which the recess for the suction mouth can be clearly seen.
Figure 3A:
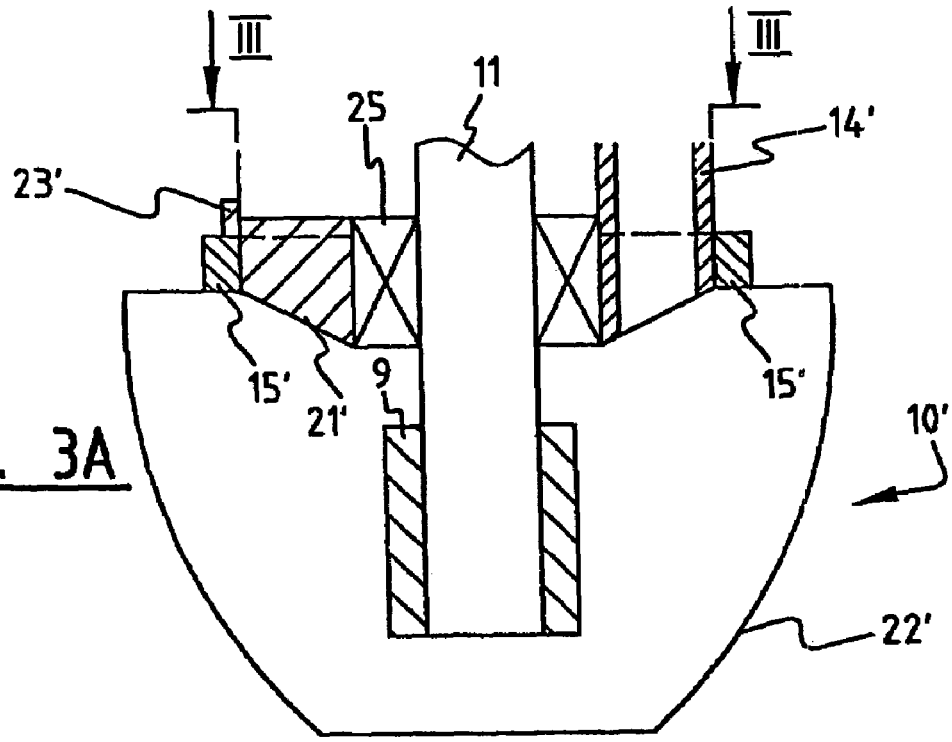
FIG. 3A is a schematic axial section of a part of a device according to the invention on which are mounted a cutter head, suction mouth and cutter shield, for instance for relatively hard bed material, rock etc.
Figure 3B:
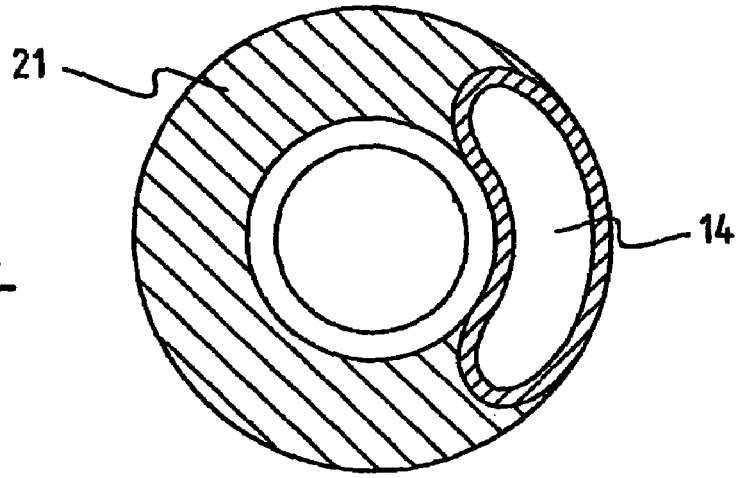
FIG. 3B shows a cross-section along line III-III in FIG. 3A.
Figure 3C:
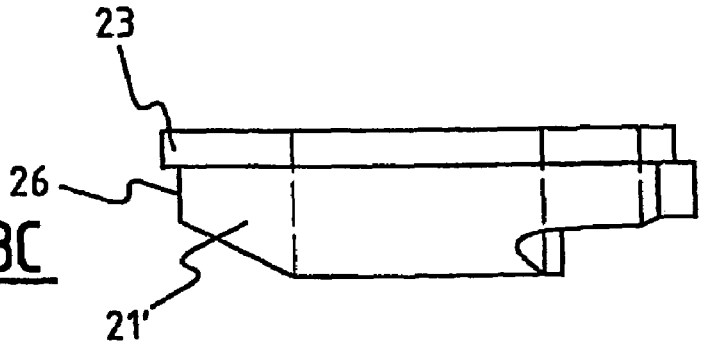
FIG. 3C shows a bottom view of the cutter shield used in the device of FIG. 3A, on which the recess for the suction mouth can be clearly seen.

The invention will now be elucidated with reference to FIGS. 2 and 3 which show the same cutter suction dredger on which are mounted a cutter head 10, 10', suction mouth 14, 14' and cutter shield 21, 21' for respectively a less hard material such as sand and for a hard material such as rock.

Figure 4:
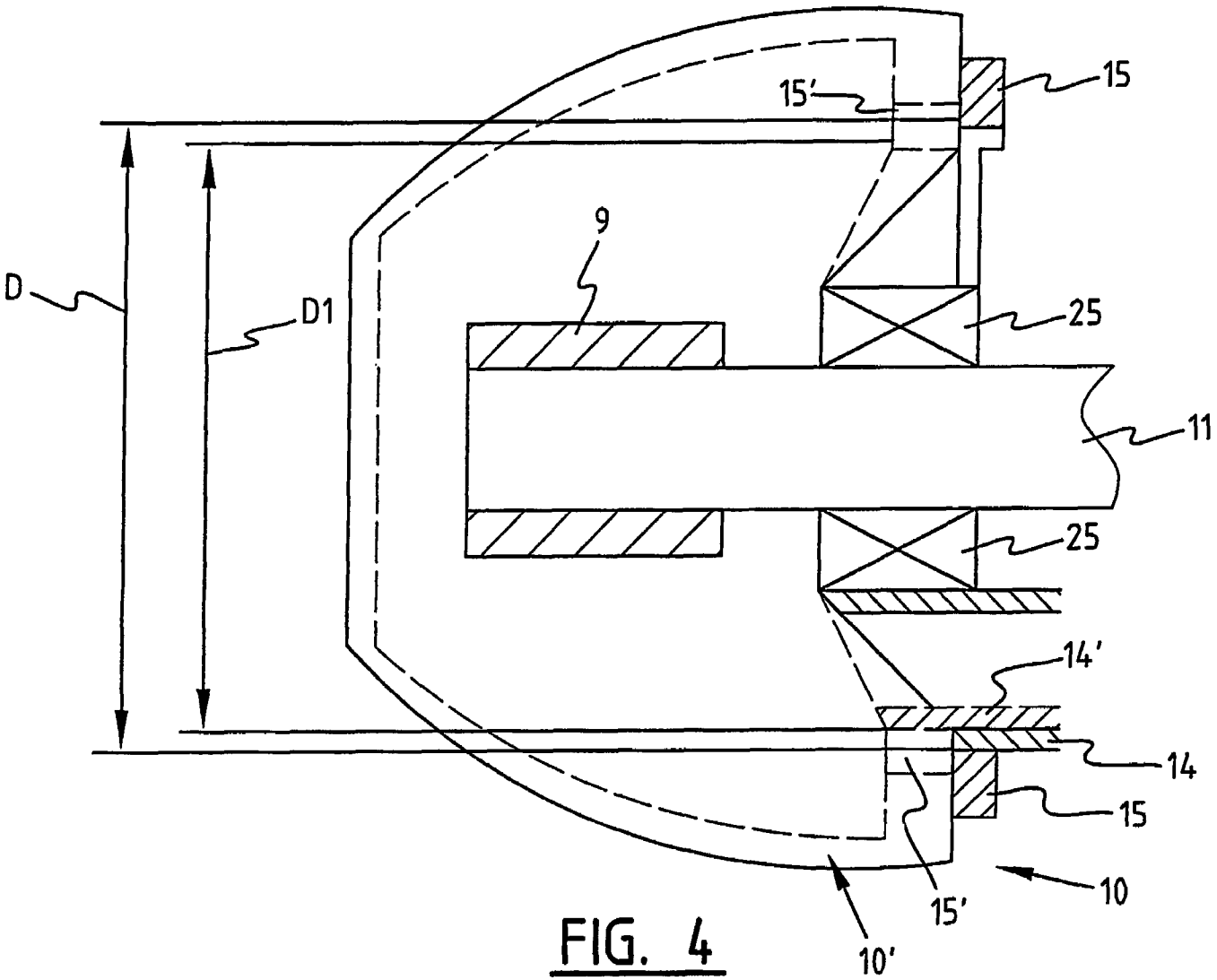
FIG. 4 shows the overlap of the schematic axial sections of FIGS. 2A and 3A.

Cutter head 10, 10' is provided with a support or back ring 15, 15' and is mounted on the drive shaft via a hub 9. In FIG. 4, which shows the overlap of FIGS. 2A and 3A, it can clearly be seen that two cutter heads 10, 10' with a different support ring diameter D, D' can be mounted on the drive shaft, wherein the support ring diameter D, D' is determined by the torque and the nature of the dredging material to be recovered.

The cutter suction dredger is further provided with a suction mouth 14, 14' which is surrounded by a fixed cutter shield 21, 21' which fills the space between the rotating support ring on one side and the suction mouth and the cutter bearing housing on the other.

As shown in FIG. 4, two suction mouths 14, 14' can be connected with a different entry section to the suction pipe. The entry section is determined by the nature of the dredging material to be recovered. A suction mouth with a larger entry section is used for instance for sand (FIG. 2B) than for instance for rock (FIG. 3B).

Cutter shield 21 forms part of the set consisting of cutter head 10 and suction mouth 14 (FIG. 3A) and cutter shield 21' of the set 10', 14' (FIG. 3B). These cutter shields 21, 21' both take the form of a truncated cone. Cutter shield 21' is extended on the rear side (large periphery) with a cylindrical peripheral edge 26.

Both shields are fixed in the same manner: at the front (top of the truncated cone) they slide over the cutter bearing housing 25 and suction mouth 14/14'. At the rear they are screwed fixedly to the front end 23 of the cutter ladder. Cutter shield 21, 21' thus fits around the front side of cutter bearing housing 25 and around the front contour of suction mouth 14, 14'. The angle of opening of the cone is chosen such that cutter shield 21, 21' fits as well as possible onto the inner edge of the support or back ring 15, 15'. The cutter shield 21' associated with a cutter head with smaller support ring 15' is extended slightly with a cylindrical peripheral edge 26 so as to fit onto the cutter ladder.

Figure 5:
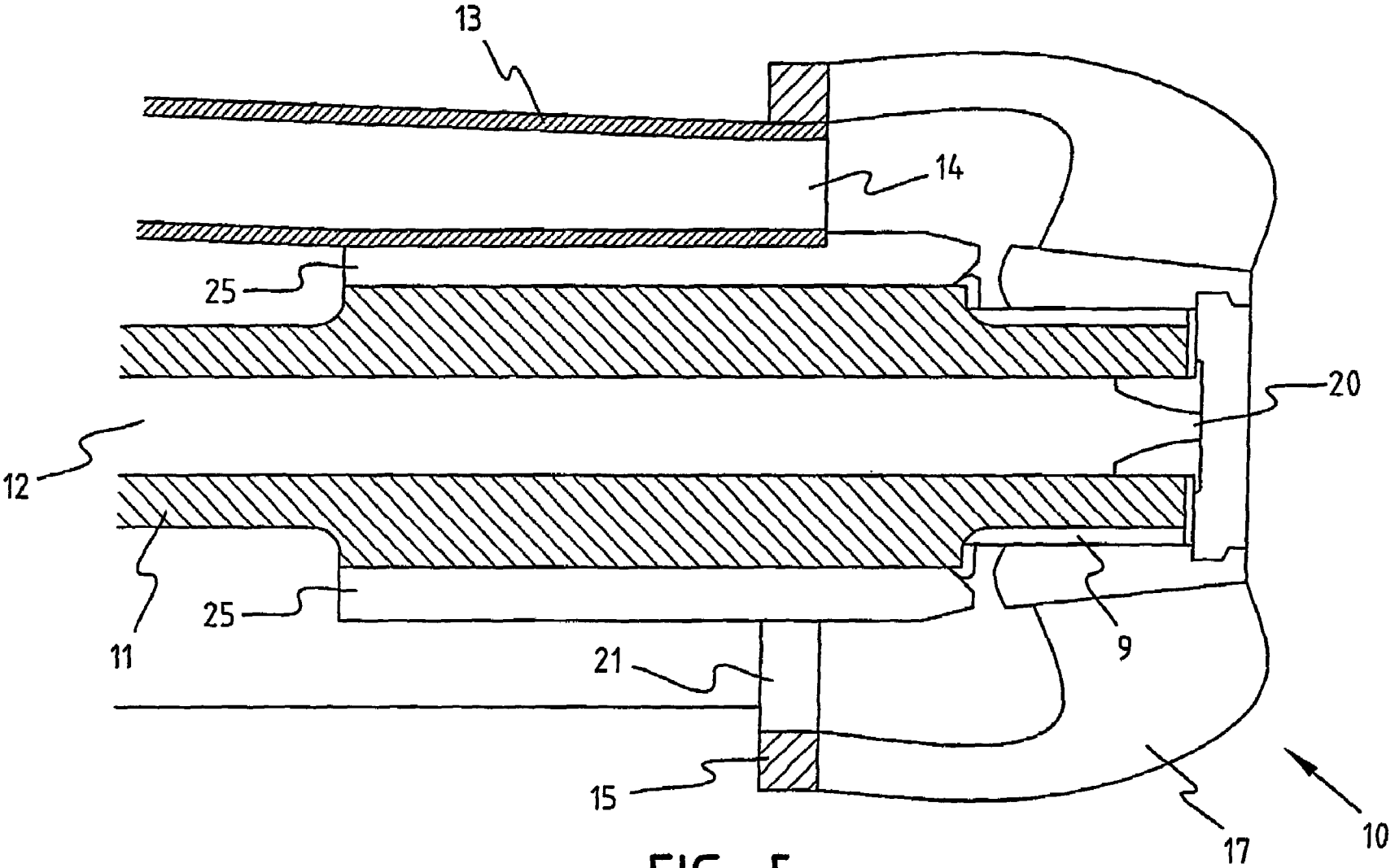
FIG. 5 is an axial section of the head of a cutter suction dredger according to the invention.

FIG. 5 shows the head of a cutter suction dredger. Cutter head 10 is mounted on drive shaft 11 by means of a hub 9. Along drive shaft 11 is provided a suction pipe 13 for sucking in the material, which can for instance be sand, dislodged by cutter head 10. This material is carried away through suction mouth 14 via suction pipe 13. Cutting blades 17 of cutter head 10 are typically provided with inserts or adapters for receiving knife points.

The drive shaft takes a hollow form for the purpose of forming a channel 12 for the surrounding water under pressure which leaves channel 12 via a nozzle 20.

The advantageous effect of injecting surrounding water under high pressure can be explained as follows. During cutting the sand grain density will decrease, whereby the volume of the sand mass increases. This creates a negative water pressure in the pores between the sand grains which, in the case of a cutter head without nozzle, cannot be immediately relieved.

Figure 6:
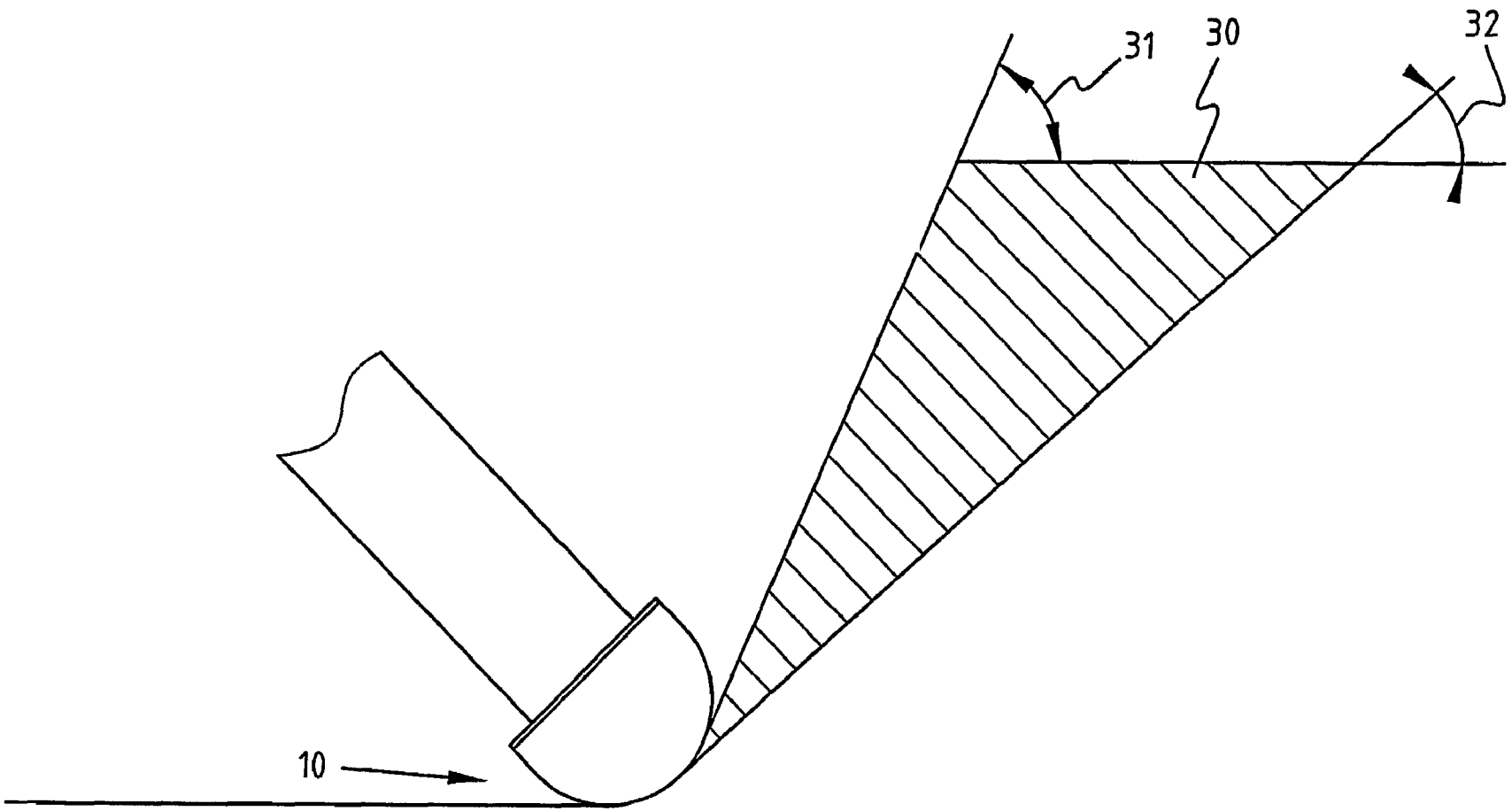
FIG. 6 is a schematic view of a bank after being cut into by a cutter suction dredger, with and without water jet injection.

When a normal cutter head is used, the negative water pressure causes the sand in the vicinity of the cutting location to remain compact, whereby bank inclines are possible which are much steeper than the natural bank angle 32 of sand in water as shown in FIG. 6.

After a certain period the negative water pressure will be compensated by the water which has flowed in, whereby the bank will subside again to form a natural bank.

When the cutter suction dredger of FIG. 5 is used, the water injected by the nozzle will compensate the negative water pressure immediately, whereby an extra quantity of sand is sucked up and the bank will more rapidly acquire its natural angle of inclination 32. The amount of dredged sand per passage of the cutter suction dredger is hereby increased considerably.

FIG. 6 illustrates a sandbank immediately after the cutter suction dredger has passed, for:

a cutter head without water jet injection which results in an angle of inclination of the bank 31;

a cutter head with water jet injection which results in an angle of inclination of the bank 32. The hatched area 30 is a measure of the possible extra production because of the water jet. The water jet moreover ensures that the breaching process proceeds more regularly, whereby production is more constant and on average it is possible to operate closer to the critical limits, or an average higher production is achieved. Due to its directly erosive action, the water jet herein also dislodges a quantity of additional bed material, which increases production.

The invention is not limited to the above described exemplary embodiments, and the scope of protection is defined solely by the following claims.

The invention claimed is:

1. Device for dislodging and recovering dredging material of varying nature, comprising a bearing housing, a drive shaft mounted therein for rotatingly driving with a determined torque a cutter head with a support ring, which cutter head is mountable on the drive shaft via a hub, a suction pipe which can be connected to a suction mouth which is surrounded by a fixed cutter shield which fills the space between the rotating support ring on the one side and the suction mouth and the bearing housing on the other, a number of cutter heads with a different support ring diameter, a first cutter head of said number of cutter heads having a first support ring dameter configured for a relatively hard bed material, including rock, a second cutter head of said number of cutter heads having a second support ring diameter configured for a relatively soft bed material, including sand, said number of cutter heads being alternatively mountable via the same hub on the drive shaft, a number of suction mouths with a different entry section which are alternatively connectable to the suction pipe, a first suction mouth of said number of suction mouths being configured for a relatively hard bed material, including rock, and being sized to cooperate with said first cutter head, and a second suction mouth of said number of suction mouths being configured for a relatively soft bed material, including sand, and being sized to cooperate with said second cutter head, the first suction mouth having a first entry section, and the second mouth having a second entry section, said first entry section being smaller than said second entry section, wherein the first support ring diameter is smaller than the second support ring diameter, the first support ring diameter being determined for a relatively hard bed material and the second support ring diameter being determined for a relatively soft bed material.

2. Device as claimed in claim 1, wherein the dimensions of the first and second suction mouths are configured such that in the operative position the bottom end fits closely between the cutter shield and the support ring of the first and second cutter heads, respectively.

3. Device as claimed in claim 2, wherein at least one nozzle is provided for spraying a fluid under high pressure into the dredging material cut into by the cutter head.

4. Device as claimed in claim 1, wherein the device further comprises a cutter ladder having a front end, and a number of cutter shields being alternatively fixable to the front end of the cutter ladder which, during use of different cutter head/suction mouth combinations, allow a first and second cutter shield of said number of cutter shields to be butting up/extending on one side to the edge of the bearing housing and the first and second suction mouth and on the other side to the inner edge of the first and second support ring and the front end of the cutter ladder, respectively.

5. Device as claimed in claim 4, wherein the bearing housing has a cylindrical outer surface and a bottom end, wherein the first and second cutter shield each have a cylindrical inner surface fitting around the cylindrical outer surface of the bearing housing, and a bottom outer surface in the form of a truncated cone narrowing in the direction of the bottom end of the bearing housing, wherein the angle of opening of the truncated cone of the first cutter shield is greater than the angle of opening of the truncated cone of the second cutter shield, the bottom outer surface of the first cutter shield, in the mounted position thereof, extending between the bottom end of the bearing housing and the front end of the cutter ladder, the bottom outer surface of the second cutter shield, in the mounted position thereof, extending between the bottom end of the bearing housing and the second support ring.

6. Device as claimed in claim 5, wherein at least one nozzle is provided for spraying a fluid under high pressure into the dredging material cut into by the cutter head.

7. Device as claimed in claim 5, wherein the device further comprises:

a cutter ladder having a front end with a bottom surface, the first support ring of the first cutter head having an upper surface;

wherein the first cutter head is dimensioned in such a way that in the mounted position thereof, the upper surface of the first support ring faces the bottom surface of the front end;

wherein the second cutter head is dimensioned such that in the mounted position thereof, the second support ring surrounds the front end of the cutter ladder.

8. Device as claimed in claim 7, the first and second support ring of the first and second cutter head each having a cylindrical inner surface, wherein the first suction mouth is adapted to closely fit between the cylindrical inner surface of the first support ring and the cylindrical outer surface of the bearing housing; and wherein the second suction mouth is adapted to closely fit between the cylindrical inner surface of the second support ring and the cylindrical outer surface of the bearing housing.

9. Device as claimed in claim 4, wherein the bearing housing has a cylindrical outer surface and a bottom end, wherein the first and second cutter shield each have a cylindrical inner surface fitting around the cylindrical outer surface of the bearing housing, and a bottom outer surface in the form of a truncated cone narrowing in the direction of the bottom end of the bearing housing, wherein the angle of opening of the truncated cone of the first cutter shield is greater than the angle of opening of the truncated cone of the second cutter shield, the bottom outer surface of the first cutter shield, in the mounted position thereof, extending between the bottom end of the bearing housing and the front end of the cutter ladder, the bottom outer surface of the second cutter shield, in the mounted position thereof, extending between the bottom end of the bearing housing and the second support ring.

10. Device as claimed in claim 4, wherein at least one nozzle is provided for spraying a fluid under high pressure into the dredging material cut into by the cutter head.

11. Device as claimed in claim 1, wherein at least one nozzle is provided for spraying a fluid under high pressure into the dredging material cut into by the cutter head.

12. Device as claimed in claim 11, wherein the drive shaft takes a hollow form in order to form a channel for the fluid under pressure, wherein the at least one nozzle is mounted on the outer end of the drive shaft connected to the cutter head.

13. Cutter suction dredger for dislodging and recovering dredging material, comprising a device as claimed in claim 1.

14. Method for dislodging and recovering dredging material using a device as claimed in claim 1, comprising the steps of:

selecting a cutter head from the number of cutter heads as a function of the dredging material to be recovered and the torque, wherein a cutter head with a smaller diameter is selected for a harder material, and connecting the selected cutter head to the drive shaft.

15. Method as claimed in claim 14, further comprising:

selecting a suction mouth from the number of suction mouths as a function of the dredging material to be recovered, wherein a smaller entry section is selected for a harder dredging material, and connecting the selected suction mouth to the suction pipe.

16. Device as claimed in claim 1, wherein the device further comprises a cutter ladder having a front end, and a number of cutter shields being alternatively fixable to the front end of the cutter ladder which, during use of different cutter head/suction mouth combinations, allow a first and a second cutter shield of said number of cutter shields to be butting up/extending on one side to the edge of the bearing housing and the first and second suction mouth and on the other side to the inner edge of the first and second support ring and the front end of the cutter ladder, respectively.

17. Device as claimed in claim 1, wherein the device further comprises:

a cutter ladder having a front end with a bottom surface, the first support ring of the first cutter head having an upper surface;

wherein the first cutter head is dimensioned in such a way that in the mounted position thereof, the upper surface of the first support ring faces the bottom surface of the front end;

wherein the second cutter head is dimensioned such that in the mounted position thereof, the second support ring surrounds the front end of the cutter ladder.

18. Device as claimed in claim 17, the first and second support ring of the first and second cutter head each having a cylindrical inner surface, wherein the first suction mouth is adapted to closely fit between the cylindrical inner surface of the first support ring and the cylindrical outer surface of the bearing housing; and wherein the second suction mouth is adapted to closely fit between the cylindrical inner surface of the second support ring and the cylindrical outer surface of the bearing housing.

* * * * *